United States Patent [19]

Duthie et al.

[11] Patent Number: 4,773,119

[45] Date of Patent: Sep. 27, 1988

[54] ROAD SWEEPING VEHICLES

[75] Inventors: Anthony J. Duthie, Horsham; Michael Sandford, Redhill, both of United Kingdom

[73] Assignee: Johnston Engineering Limited, Surrey, United Kingdom

[21] Appl. No.: 38,533

[22] Filed: Apr. 14, 1987

[30] Foreign Application Priority Data

Apr. 14, 1986 [GB] United Kingdom ..... 8609016

[51] Int. Cl.[4] ..... E01H 1/08

[52] U.S. Cl. ..... 15/340.1; 15/412; 192/58 R; 416/60

[58] Field of Search ..... 15/340, 412; 416/60; 192/58 R, 58 A, 58 B

[56] References Cited

U.S. PATENT DOCUMENTS 3,172,143 3/1965 Yucis et al. ..... 15/340

4,356,589 11/1982 Mealing et al. ..... 15/412 X

*Primary Examiner*—Chris K. Moore

*Attorney, Agent, or Firm*—Young & Thompson

[57] ABSTRACT

A suction type road sweeping vehicle includes a fluid coupling in the drive train between the auxiliary engine and the vacuum generating fan. The fluid coupling is mounted integrally with the engine flywheel and drives a step up gearbox. The flywheel, coupling and gearbox are housed in a compact housing attached to the engine and routine in the coupling. The use of the fluid coupling alleviates vibrational problems associated with elastic properties in existing couplings and thereby enables a more robust fan having a greater moment of inertia to be used.

6 Claims, 2 Drawing Sheets

ROAD SWEEPING VEHICLES

This invention relates to road sweeping vehicles of the suction type.

Such vehicles are known in which an exhauster fan generates a vacuum within an air tight container mounted on the vehicle chassis and debris from the road is sucked through suction conduits connected to the container. In addition to the propulsion unit of the vehicle an auxiliary engine is provided for driving the suction fan and sweeping machinery.

The fan and engine are typically connected by a drive train which includes a centrifugal clutch or drive belts or rubber couplings. A problem exists with such drive trains in that they possess elastic properties which can result in torsional vibration excited by the engine's torsional and cyclic vibration characteristics particularly during acceleration or deceleration of the drive when critical speeds may be endured. Consequently it has been found that in order to reduce vibration and the effects of shock it has been necessary to use a fan with a lowest moment of inertia practicable. Since the fan is subjected in use to impacts and erosion from particles of debris there have been difficulties in achieving fan constructions which are both sufficiently robust and sufficiently low in moment of inertia.

According to the present invention there is disclosed a suction type road sweeping vehicle comprising a self propelled chassis, an air tight container mounted on the chassis, at least one suction conduit connected to the container, a fan for generating a vacuum in the container by extracting air through an outlet duct, an engine for driving the fan and a drive train communicating between the engine and the fan wherein the drive train includes a fluid coupling.

An advantage of using a fluid coupling is that it is substantially free of elastic properties in transmitting torsional drive and also such couplings have a considerable affinity for absorbing torsional shock.

Preferably the fluid coupling and the engine flywheel are of integral construction.

Conveniently the drive train comprises a fluid coupling within the engine flywheel, an output shaft of the coupling connected to theinput of a step up gearbox and an output shaft of the gearbox connected to the fan.

Conveniently the fluid coupling and the gearbox are housed in a common housing connected to the engine.

It is possible to construct a fan of a more robust design than has been hitherto possible without incurring the penalty of vibration or shock damage to the drive train.

Preferably the fluid coupling provides slippage in the drain train of not more than 5% under conditions of maximum drive speed.

Conveniently the vehicle includes access ports through which the fluid level in the fluid coupling may be externally monitored. An advantage of this is that the drive train components need only be separated when major overhaul is required and routine maintenance will generally be limited to checking the fluid level through an access port.

Figure 1:
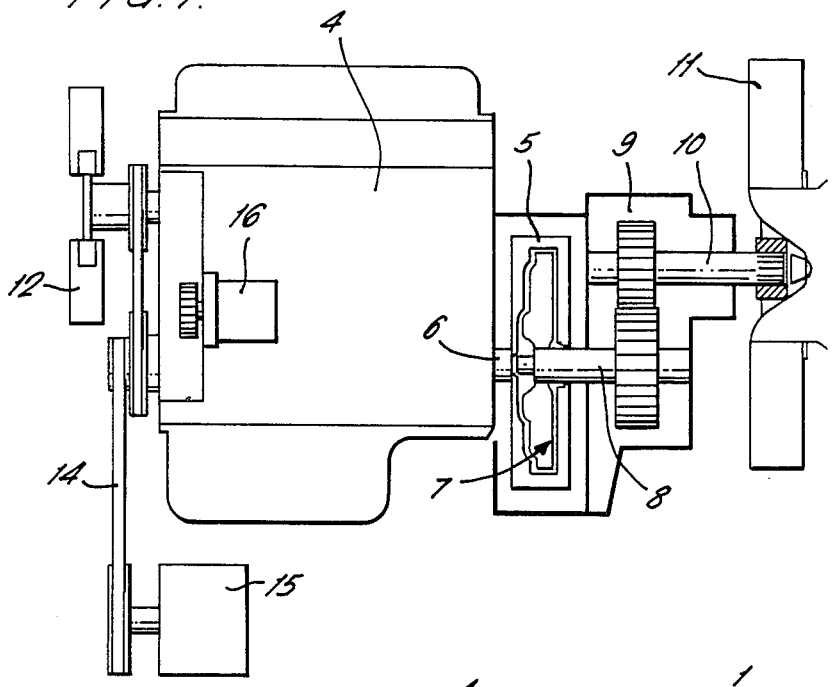
Figure 2:
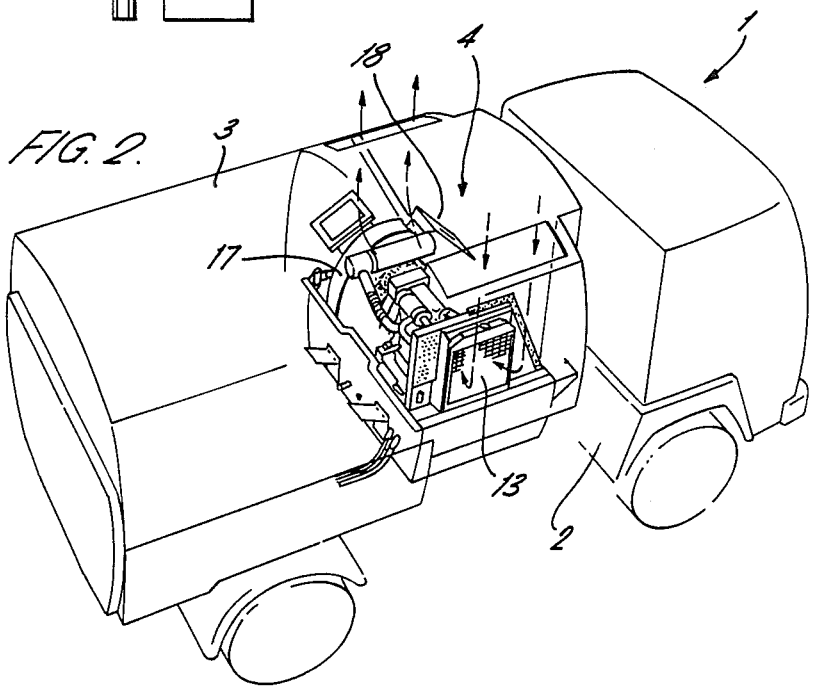
Figure 3:
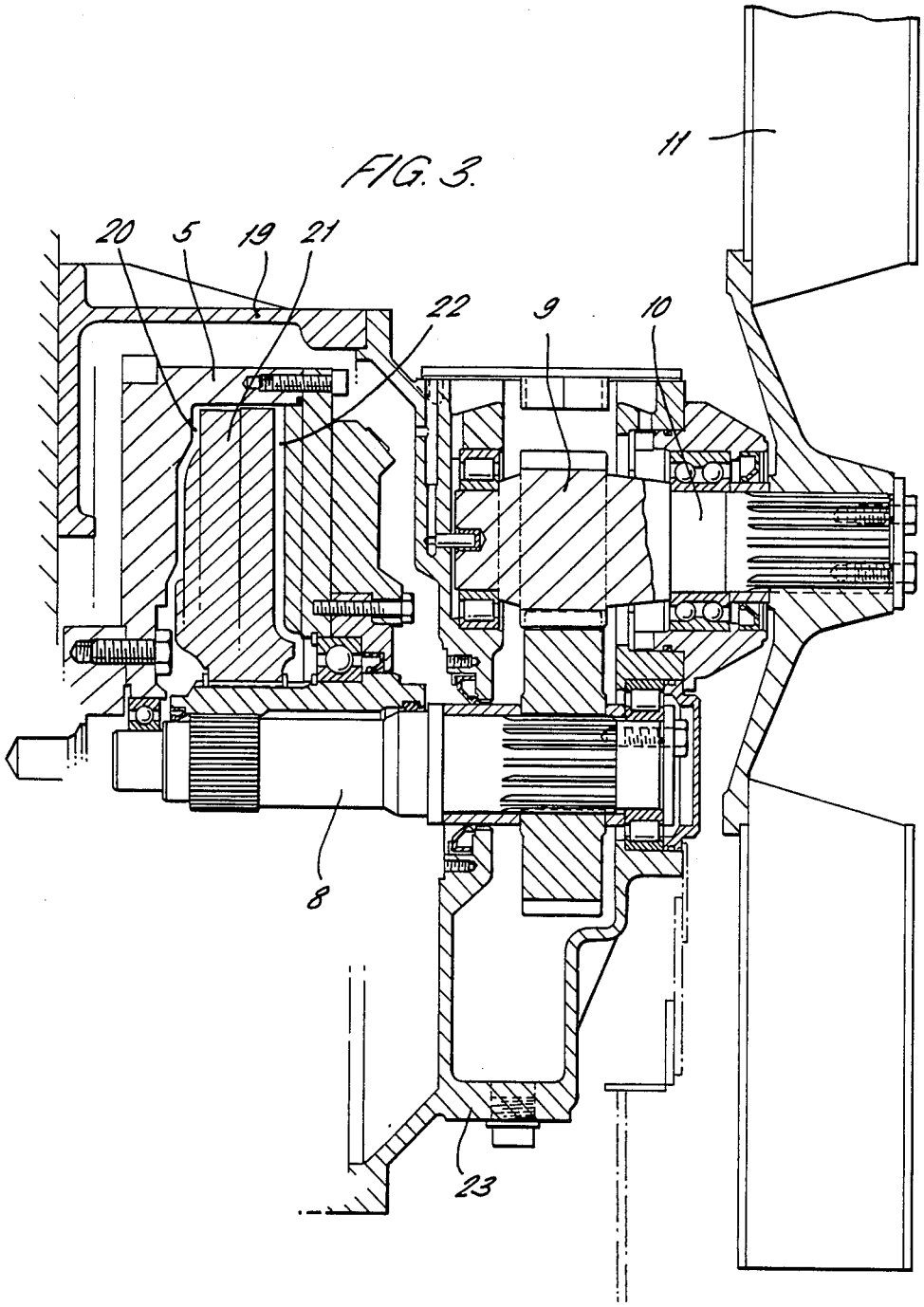

A specific embodiment of the invention will now be described by way of example only and with reference to the accompanying drawings of which FIG. 1 is a schematic sectional elevation of the engine, drive train and fan of a road sweeping vehicle, FIG. 2 is a schematic perspective part cut-away view of a road sweeping vehicle and FIG. 3 is a sectional elevation showing details of the drive train of FIG. 1.

The road sweeping vehicle 1 of FIG. 2 comprises a self propelled chassis 2 on which is carried an air tight container 3. An auxiliary engine 4 is mounted on the chassis 2 for driving a suction fan and sweeping machinery. Suction conduits (not shown) beneath the vehicle operate in conjunction with the sweeping machinery to collect debris which is sucked into the container 3.

FIG. 1 shows the engine 4 which is a four cylinder diesel engine having a flywheel 5 connected to the engine's output shaft 6. A fluid coupling 7 within the flywheel 5 couples the drive from the flywheel 5 to a gearbox input shaft 8 of a step up gearbox 9 having an output shaft 10 driving a centrifugal fan 11.

The engine 4 also drives a conventional engine cooling fan 12 providing air flow through a radiator 13 as shown in FIG. 2. The engine also has a pulley drive 14 for driving a water pump supplying water for dust suppression sprays around the sweep gear (not shown). A hydraulic pump 16 is driven by the engine's power-take-off facility and this provides hydraulic power to the sweep gear.

The centrifugal fan 11 is located in a fan housing 17 and expels air from the container 3 through an outlet duct 18.

In FIG. 3 a flywheel housing 19 contains the flywheel 5 which has an oil filled chamber 20 within which a driven plate 21 of the fluid coupling 7 is rotatable. Torque for the engine is transmitted across an oil filled interface 22 from the flywheel 5 to the driven plate 21 so as to drive the gearbox input shaft 8 which is splined to the driven plate 21.

The flywheel housing 19 is extended by a gearbox housing 23 containing a step up gearbox 9 having an output shaft 10 on which is mounted the centrifugal fan 11.

Upon starting the engine 4 the flywheel 5 rotates and torque is transmitted to the driven plate 21 across the oil filled interface 22. Drive is transmitted to the centrifugal fan 11 which begins to rotate. Some slippage in the drive train comprising the flywheel 5, fluid coupling 7, at gearbox 9 is experienced particularly at engine idling speeds due to the inherent properties of the fluid coupling. However as the engine is accelerated to full power the torque transmitted by the fluid coupling 7 is such that slippage is reduced to less than 5%.

In a particular example a fan 725 mm diameter and 80 mm depth includes 16 blades. At engine speeds of 1500 rpm and 1800 rpm the fan speed was greater than 2620 rpm and 3150 rpm respectively using a gearbox ratio of 1:1.79. This represents a nominal slippage of 2.5%.

To reduce the effects of engine vibration to a minimum, only the engine, the drive train and the fan are live mounted, whilst the radiator 13, the fan housing 17 and the water pump 15 are separately mounted away from the engine.

Since the fan 11 will encounter impacts and abrasion from residual debris in the exhausted air, the fan can now be of an advantageously heavy duty construction with self cleaning abrasion resistant blades, due to the fact that the fan design is no longer subject to the constraint of moment of inertia matching to the engine's torsional and cyclic vibration characteristics.

We claim:

1. A suction type road sweeping vehicle comprising a self propelled chassis, an air tight container mounted on the chassis, at least one suction conduit connected to the container, a fan for generating a vacuum in the container by extracting air through an outlet duct, an engine for driving the fan and a drive train communicating between the engine and the fan wherein the drive train includes a fluid coupling which is of integral construction with a flywheel of said engine.

2. A road sweeping vehicle as claimed in claim 1 wherein the drive train comprises a fluid coupling within the engine flywheel, an output shaft of the coupling connected to the input of a step up gearbox and an output shaft of the gearbox connected to the fan.

3. A road sweeping vehicle as claimed in claim 2 wherein the fluid coupling and the gearbox are housed in a common housing connected to the engine.

4. A road sweeping vehicle as claimed in claim 3 including access ports in said housing through which the fluid level in the fluid coupling may be externally monitored.

5. A road sweeping vehicle as claimed in claim 1 wherein the moment of interia of the fan is substantially greater than that of the flywheel.

6. A road sweeping vehicle as claimed in claim 1 wherein the fluid coupling provides slippage in the drive train of not more than 5% under conditions of maximum drive speed.

* * * * *